US008690006B1

(12) United States Patent
Chiorazzi et al.

(10) Patent No.: US 8,690,006 B1
(45) Date of Patent: Apr. 8, 2014

(54) TILTED GROOVED BEVERAGE DRINKING CONTAINER

(71) Applicants: Frank P. Chiorazzi, Salinas, CA (US); Frank O. Chiorazzi, Salinas, CA (US)

(72) Inventors: Frank P. Chiorazzi, Salinas, CA (US); Frank O. Chiorazzi, Salinas, CA (US)

(73) Assignee: Franmara, Inc., Salinas, CA (US)

( * ) Notice: Subject to any disclaimer, the term of this patent is extended or adjusted under 35 U.S.C. 154(b) by 0 days.

(21) Appl. No.: 13/632,827

(22) Filed: Oct. 1, 2012

(51) Int. Cl.
*A47G 19/22* (2006.01)
*B25G 1/10* (2006.01)
*B65D 25/28* (2006.01)

(52) U.S. Cl.
CPC ..... *A47G 19/2255* (2013.01); *B25G 1/102* (2013.01); *A47G 19/2205* (2013.01); *B65D 25/2897* (2013.01)
USPC ..... 220/755; 220/608; 220/771; 16/430

(58) Field of Classification Search
CPC . A47G 19/2255; A47G 19/2205; B65D 1/40; B65D 25/2897; B65D 25/2885; B65D 25/2882; B65D 23/102; B65D 23/10; B25G 1/102; B25G 1/10
USPC ..... 220/675, 669, 755, 771, 752, 608, 606; 215/384, 383, 382, 398, 396, 395, 373, 215/372, 371; D7/533, 532, 529, 523; 16/430
See application file for complete search history.

(56) References Cited

U.S. PATENT DOCUMENTS

| | | | | | |
|---|---|---|---|---|---|
| D98,614 | S | * | 2/1936 | Prouty | D7/532 |
| 2,142,811 | A | * | 1/1939 | Agonis | 215/384 |
| 2,772,704 | A | * | 12/1956 | McConnell et al. | 141/24 |
| 3,536,500 | A | * | 10/1970 | Cleereman et al. | 426/130 |
| D244,502 | S | * | 5/1977 | Harbaugh et al. | D7/532 |
| D250,574 | S | * | 12/1978 | Boyle | D9/537 |
| D306,261 | S | * | 2/1990 | Rader | D9/552 |
| 5,052,567 | A | * | 10/1991 | Colani | 215/384 |
| 5,927,533 | A | * | 7/1999 | Payne et al. | 215/384 |
| 6,164,474 | A | * | 12/2000 | Cheng et al. | 215/384 |
| 6,189,715 | B1 | * | 2/2001 | Dubois | 215/374 |
| D461,369 | S | * | 8/2002 | Sims et al. | D7/531 |
| D614,963 | S | * | 5/2010 | Arnell | D9/537 |
| D619,897 | S | * | 7/2010 | Arnell | D9/516 |
| 2007/0090083 | A1 | * | 4/2007 | Trude | 215/384 |
| 2010/0230378 | A1 | * | 9/2010 | Colloud | 215/384 |

OTHER PUBLICATIONS

U.S. Appl. No. 29/419,952, filed May 3, 2012; Chiorazzi, Frank P. et al.
Govino wine glass photo (See Attachment A).

* cited by examiner

*Primary Examiner* — Robert J Hicks
(74) *Attorney, Agent, or Firm* — LaRiviere, Grubman & Payne, LLP

(57) ABSTRACT

A beverage container having a tilted groove at or near the bottom of the bowl or reservoir of the container. The groove, of substantially uniform depth and shape, encircles the entire circumference of the reservoir, and is inclined at a preselected acute angle with respect to the bottom thereof for enhancing the drinker's grip.

5 Claims, 13 Drawing Sheets

TILTED GROOVED BEVERAGE DRINKING CONTAINER

PRIORITY CLAIM

This application claims the benefit of U.S. Design patent application Ser. No. 29/419,952, filed May 3, 2012 under 35 U.S.C. §120.

TECHNICAL FIELD

The present invention relates to beverage drinking containers, more particularly, stemless glassware. Such containers may be made of a variety of material, such as glass, plastic, crystal or other disposable and/or non-breakable material, and will be referred hereinafter as "containers or glasses".

BACKGROUND ART

Beverage drinking containers come in all sizes, shapes, colors and materials. Until relatively recently, most wine, aperitif and some mixed drink glasses had shaped reservoirs or bowls disposed atop a stem, and shaped according to traditional preferences for the beverages being served.

So-called "stemless" glasses are known in the art as an alternative for serving such beverages. These glasses typically retain the shape of a reservoir or bowl but without the stem as shown in prior art FIG. 1. However, the reservoir of such stemless glasses is often large and cumbersome to grasp, especially for persons having smaller hands or shorter fingers, or both. To meet this challenge, some manufacturers have added one or more indentations about midway between the top and bottom of the container to help the drinker steady or acquire better control of his or her grip on it as shown in prior art FIGS. 2*a* and 2*b*. However, in such a configuration the drinker must usually grasp the bowl of the glass at a location having the largest diameter of the bowl which, again, for smaller hands or shorter fingers is not comfortable nor practical.

In addition, such stemless glasses are often made of alternative, often non-breakable or disposable materials, such as plastic, polycarbonate, or other flexible material including, Polyethylene Terephthalate Glycol (PETG). However, these glasses also tend to be fairly flexible even at the midway point of the bowl, again making the drinker's grip uncertain. If the beverage is relatively cold and humidity is sufficiently high, the outside surface of the container may attract condensation, making the glassware slippery and even harder to grasp without deforming the flexible bowl and risking spillage of the beverage, and potentially loss of grip entirely.

BEST MODE FOR CARRYING OUT THE INVENTION

Figure 1:
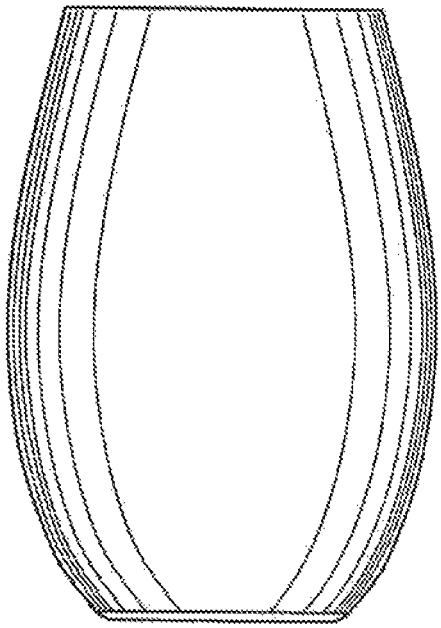
FIG. 1 (Prior Art)
FIG. 1 is a side view of a prior art stemless glass without gripping indentations.
Figure 2A:
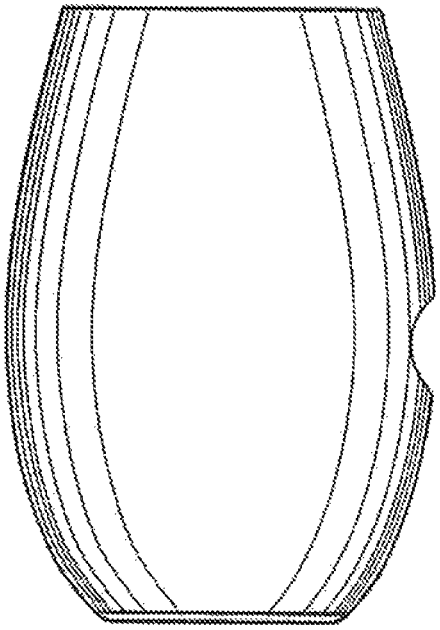
FIG. 2a (Prior Art)
FIGS. 2*a* and 2*b* are side views of prior art stemless glasses with gripping indentations.
Figure 2B:
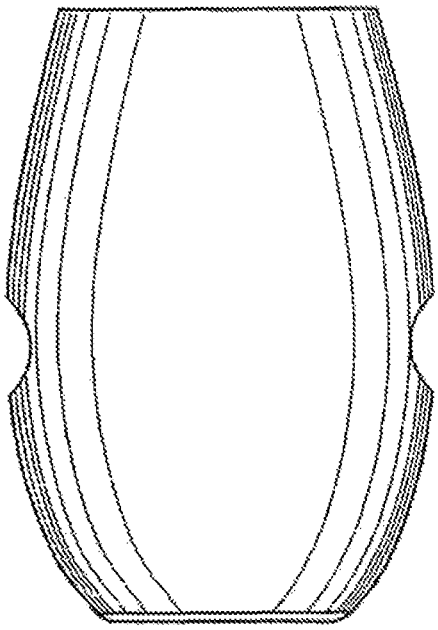
FIG. 2b (Prior Art)
Figure 3:
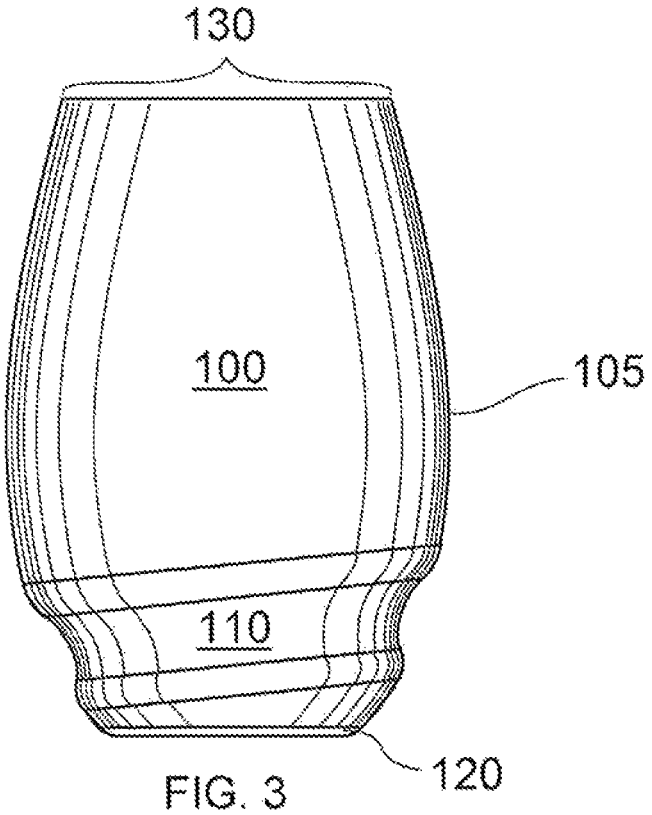
FIG. 3 is a side view of a stemless glass having a groove tilted with respect to, and disposed at or near, the bottom of the glass in accordance with the principles of the present invention.

FIGS. 1 and 2 show stemless glasses known in the art without an angled or tilted groove. FIG. 3 shows a side view of the stemless glass according to the principles of the present invention including beverage container 100, also reservoir or bowl herein, having groove 110 on the outer diameter of the generally cylindrical side wall 105 of container 100. As shown, the tilted groove is preferably disposed at or near, bottom 120 thereof, for added gripping control by one or more of the drinker's fingers. Obviously, use of groove 110 is not limited to any particular finger. However, as will be described elsewhere in this specification, a typical finger of choice would be either the little or ring finger or both. In this way the drinker's hand is not required to encircle the largest diameter of the bowl, but rather can grasp the container at a location having a relatively small diameter. This novel feature improves the gripping control of the user of a potentially slippery, wide-body reservoir constructed of potentially flexible material, especially for someone having a small hand or short fingers, or both. Groove 110 fully encircles the outer surface of generally cylindrical wall 105. Top 130 of container 100 defines an opening in the upper portion of the container.

Figure 4:
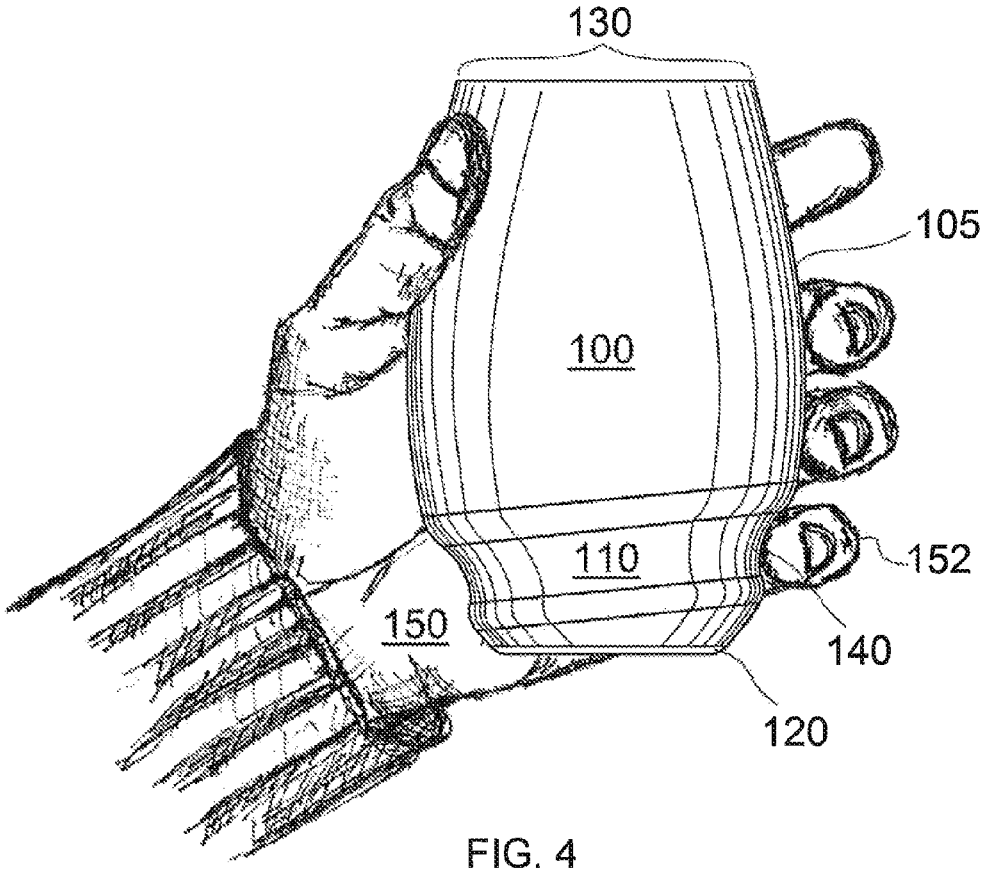
FIG. 4 is a side view of the stemless glass of FIG. 3 showing a single-finger grip in the groove.
Figure 5:
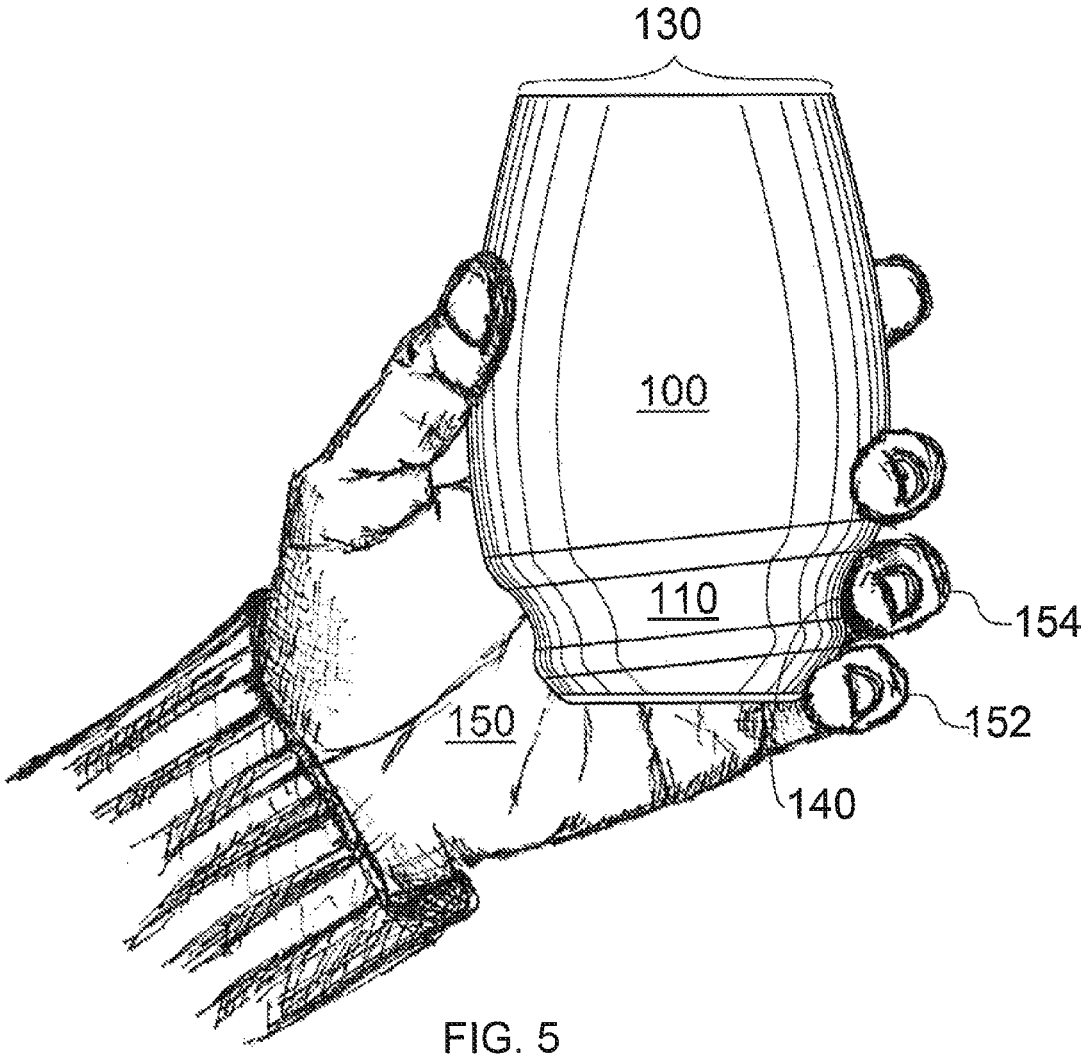
FIG. 5 is a side view of the stemless glass of FIG. 3 showing a two-finger grip at the groove.

Referring now to FIG. 4, beverage container 100 is shown with tilted groove 110 formed in side wall 105 and being held by drinker's hand 150. Little finger 152 is shown gripping container 100 at tilted groove 110 at generally the highest point 140 of groove 110 on the outer diameter of the container 100 above bottom 120. FIG. 5 shows container 100 of FIG. 3 where the drinker has placed a ring finger 154 in groove 110.

Figure 6A:
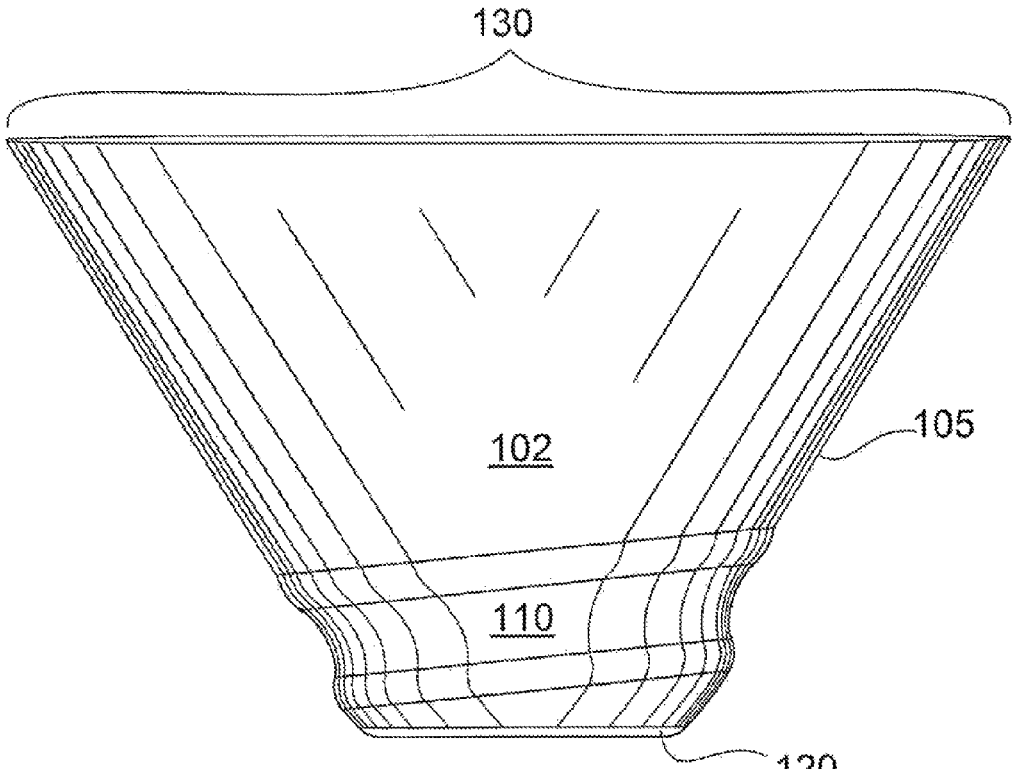
FIGS. 6*a* and 6*b* show side views of other embodiments of the stemless glass having a groove formed in the cylindrical side wall tilted with respect to, and disposed at or near, the bottom of the glass in accordance with the principles of the present invention.
Figure 6B:
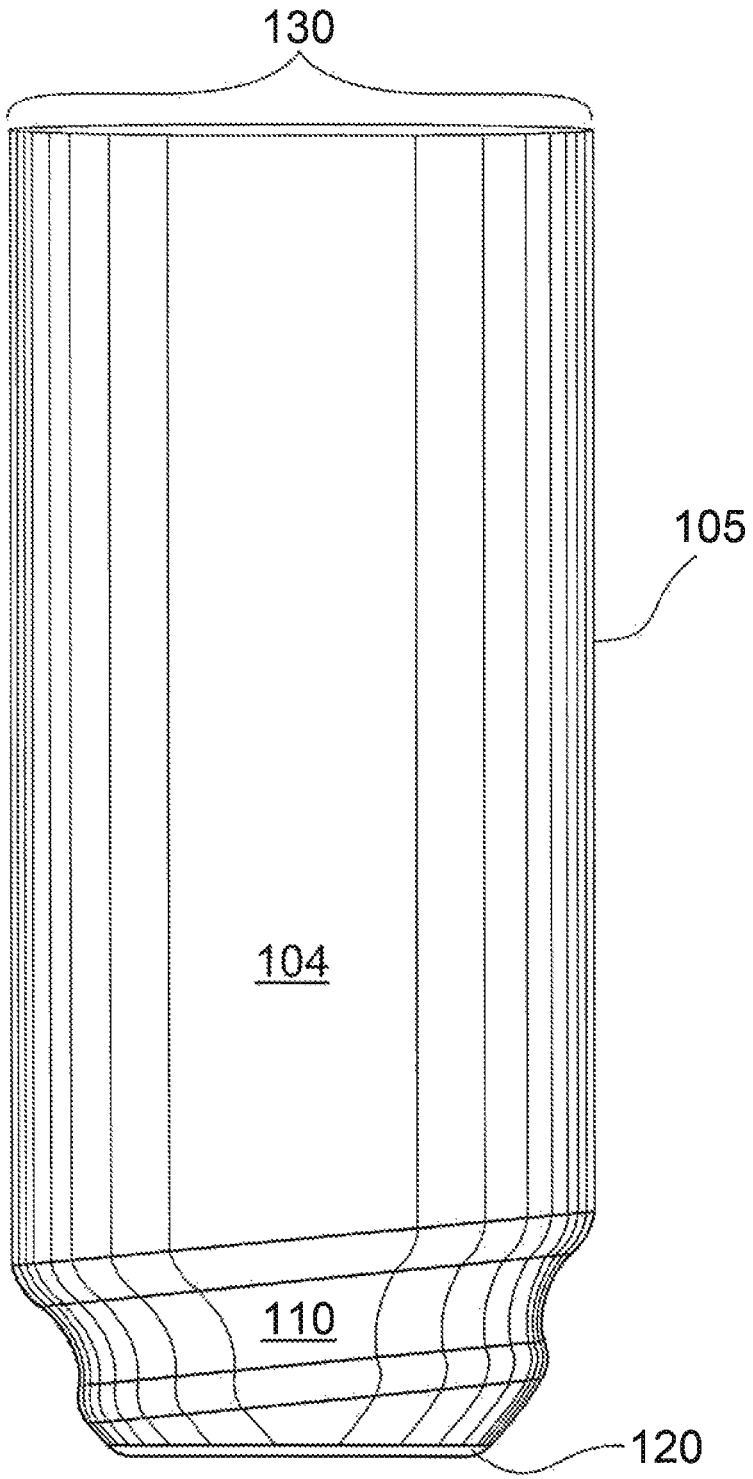

Of course, the present invention is not limited to any single reservoir or bowl shape. Referring to FIGS. 6*a* and 6*b*, groove 110 of the present invention can be conveniently incorporated into other shapes of beverage drinking containers. FIG. 6*a* shows a side view of a glass 102 having a relatively narrow bottom and tilted groove located at or near bottom 120 relative to top 130. FIG. 6*b* shows a side view of a tall drinking glass 104 including tilted groove 110 according to the principles of the present invention.

Figure 7:
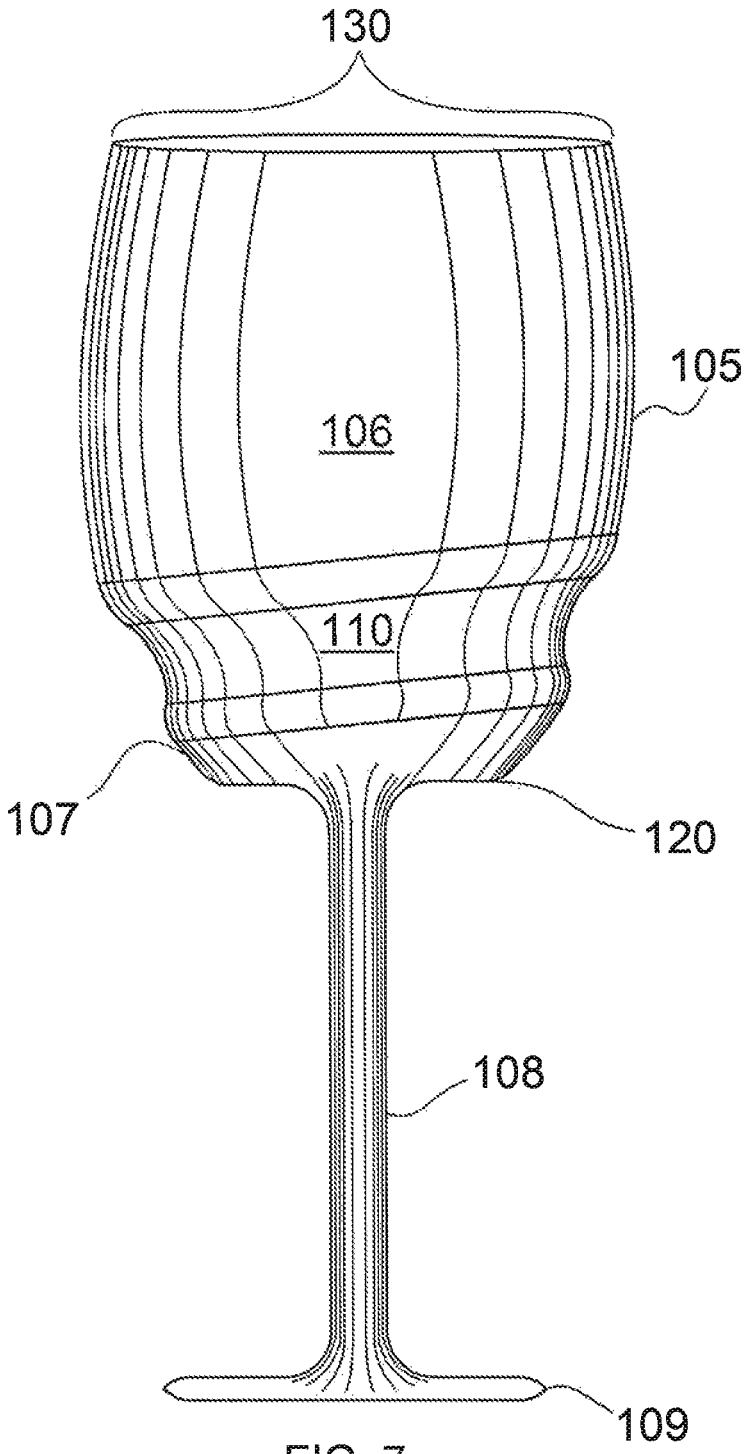
FIG. 7 is another embodiment of the present invention showing a side view of the container having a groove disposed at or near the bottom of the bowl of a stemmed glass, the groove being tilted in accordance with the principles of the present invention.

In another embodiment of the present invention as shown in FIG. 7, tilted groove 110 is incorporated into stemmed glass 106, at or near the bottom of the bowl 107, according to the principles of the present invention. Many drinkers prefer to hold a stemmed glass by stem 108 or base 109 while drinking. However, while serving or cleaning such glassware, the addition of tilted groove 110 similarly enhances the server's or cleaner's grip during the serving or cleaning operations.

Obviously, the present invention is not limited to any particular material, since it can be utilized with any beverage drinking container of any shape and practical size, constructed of any material that is used in making such containers.

Figure 8:
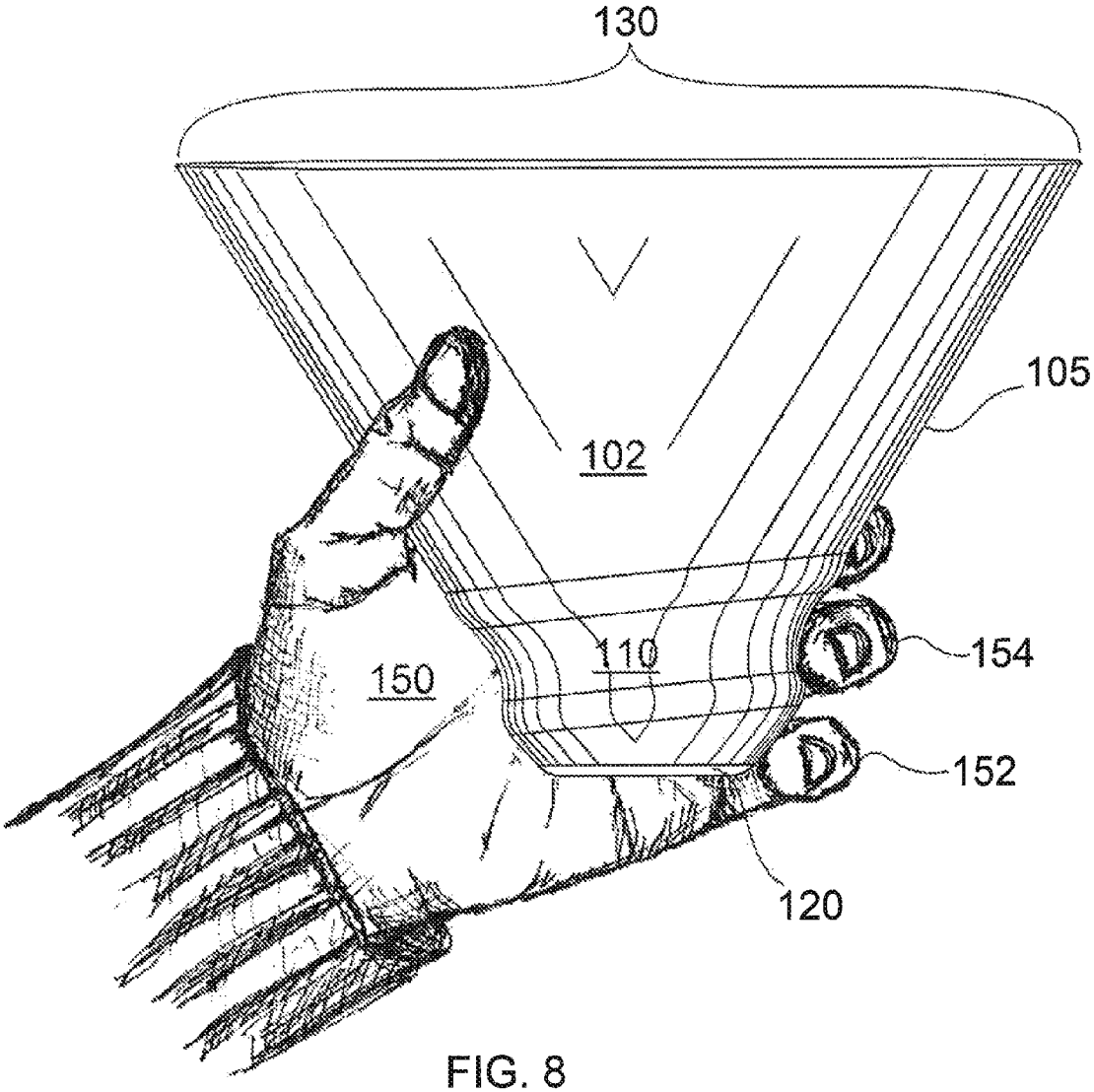
FIG. 8 shows the embodiment of the present invention of FIG. 6*a* in use.
Figure 9:
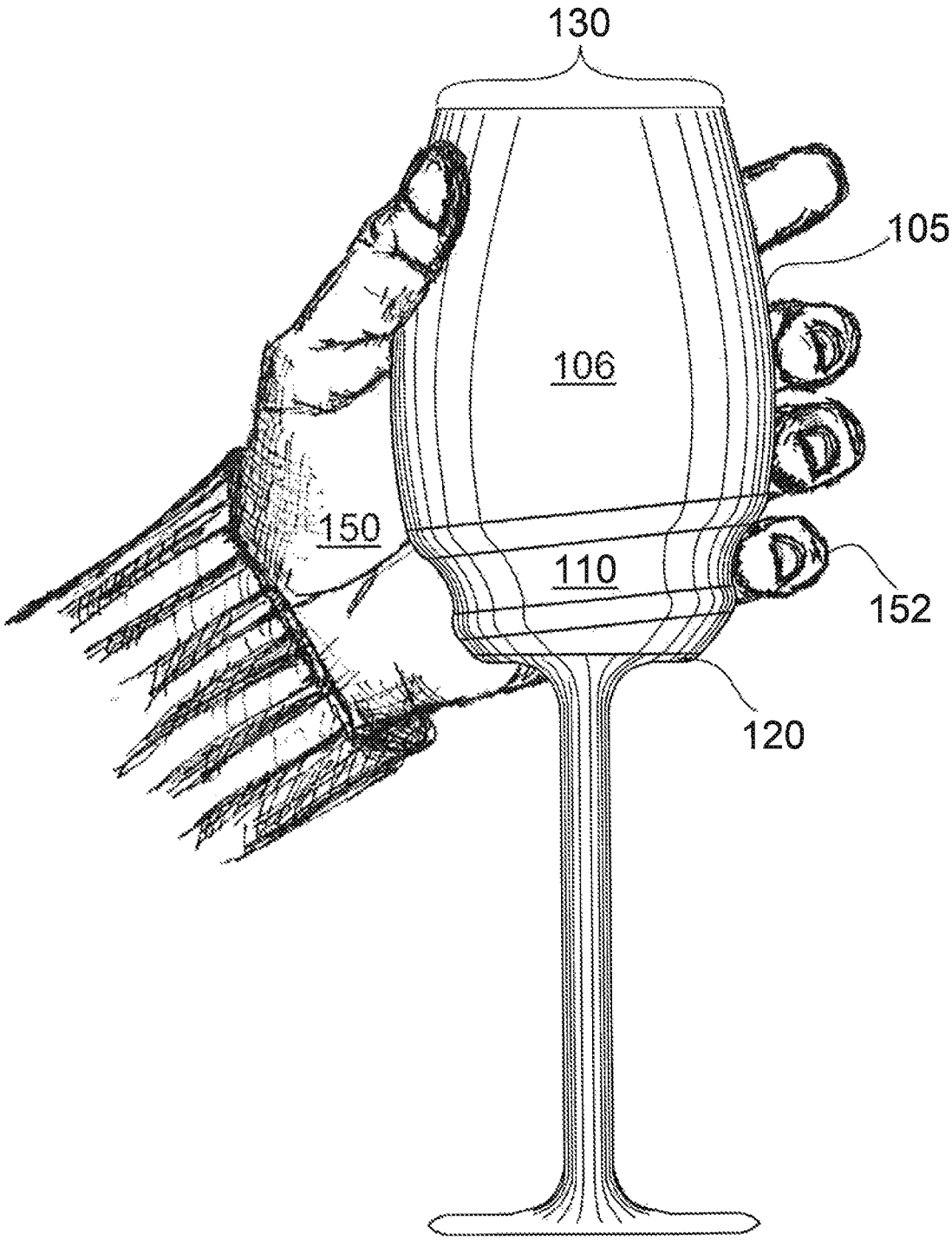
FIG. 9 shows the embodiment of the present invention of FIG. 7 in use.

With continuing reference to FIGS. 8 and 9, hand 150 is shown gripping the containers 102 and 106 using groove 110. Ring finger 154 enhances the grip on container 102, and little finger 152 enhances the grip on stemmed glassware 106, according to the present invention.

Figure 10A:
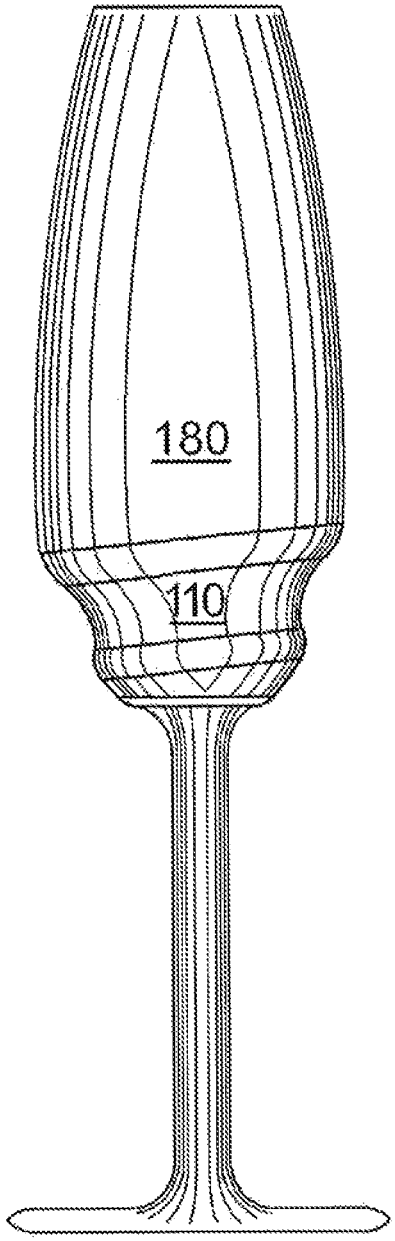
FIGS. 10*a* and 10*b* show side views of a stemmed and stemless champagne flute, respectively, according to the present invention.
Figure 10B:
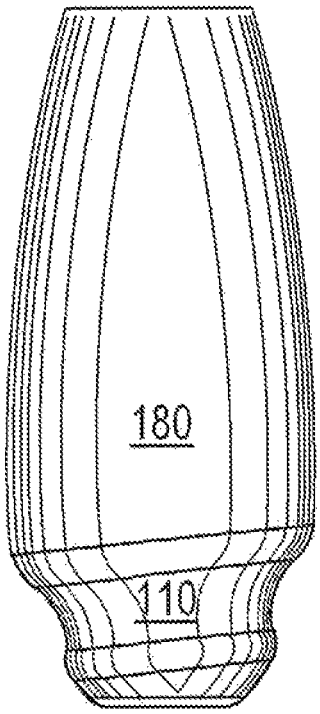

Referring to FIGS. 10*a* and 10*b*, stemmed and stemless champagne flutes 180 also include tilted groove 110 according to the present invention.

The angle at which groove 110 is tilted with respect to bottom 120 or top rim 130 may vary somewhat depending on the materials used for constructing container 100. However, the preferred angle is approximately 9 degrees or in the range of 5 degrees to 20 degrees. Similarly, the groove for the other container configurations is set at approximately the same angle with respect to bottom 120 or top rim 130.

The preferred embodiments of the invention are not limited to those described herein. The description is for purpose of illustration only and not limitation. Other systems, methods, features and advantages will be or will become apparent to one with skill in the art upon examination of the figures and detailed description. It is intended that all such additional systems, methods, features and advantages be included within this description, be within the scope of the inventive subject matter, and be protected by the accompanying claims.

What is claimed is:

1. A beverage drinking container comprising:

a substantially cylindrical reservoir having a bottom for containing a beverage; and a groove having a preselected depth to accommodate gripping by one finger, formed at or near the bottom of the reservoir encircling the entire circumference of the container and being inclined at a preselected acute angle with respect to the bottom thereof, for enhancing the grip of the hand of the user.

2. A beverage container for receiving and containing liquids comprising:

a bottom and an upper portion;

a cylindrical side wall attached to the bottom, the side wall having an opening on the upper portion thereof and a recessed groove formed in the outer surface thereof to receive one or more fingers of a hand of a user when the user is holding the container;

the groove, completely encircling the cylindrical side wall, being inclined to run from a position, that is relatively closer to the bottom to a position that is relatively further from the bottom and having a uniform size to accommodate gripping by a portion of the finger along its entire length; and the bottom and cylindrical side wall being formed for receiving and containing liquids within the container.

3. A beverage container as in claim 1, wherein the depth of the groove is substantially uniform along its entire length.

4. A beverage container as in claim 1, wherein the cross-sectioned shape of the groove is substantially uniform along its entire length.

5. A beverage container as in claim 1 or 2, wherein the groove further supports a two-finger grip in cooperation with the bottom thereof.

* * * * *

UNITED STATES PATENT AND TRADEMARK OFFICE

CERTIFICATE OF CORRECTION

PATENT NO. : 8,690,006 B1
APPLICATION NO. : 13/632827
DATED : April 8, 2014
INVENTOR(S) : Frank P. Chiorazzi et al.

It is certified that error appears in the above-identified patent and that said Letters Patent is hereby corrected as shown below:

In the Claims:
Claim 1, Column 3, line 32, insert -- portion -- after “bottom” and before “for”;
Claim 2, Column 4, line 16, delete the “,” after “position”.

Signed and Sealed this
Sixteenth Day of December, 2014

Michelle K. Lee

Michelle K. Lee
*Deputy Director of the United States Patent and Trademark Office*